United States Patent [19]

Trolle

[11] 4,056,347

[45] Nov. 1, 1977

[54] ISOSTATIC COMPACTOR OF PULVERULENT MATERIALS AND THE LIKE

[75] Inventor: Sten Trolle, Ystad, Sweden

[73] Assignee: AB Carbox, Ystad, Sweden

[21] Appl. No.: 754,420

[22] Filed: Dec. 27, 1976

[51] Int. Cl.[2] ..... B30B 5/02; B30B 11/00

[52] U.S. Cl. ..... 425/405 H; 425/78

[58] Field of Search ..... 425/405 H, 405 R, 78

[56] References Cited

U.S. PATENT DOCUMENTS

| | | | |
|---|---|---|---|
| 3,454,997 | 7/1969 | Legon et al. | 425/405 H |
| 3,550,198 | 12/1970 | Roberts | 425/405 H X |
| 3,551,946 | 1/1971 | Backer et al. | 425/405 H X |

*Primary Examiner*—J. Howard Flint, Jr.
*Attorney, Agent, or Firm*—Flynn & Frishauf

[57] ABSTRACT

An apparatus for isostatic compression of pulverulent materials comprises a pressure vessel housing two liquids which by a flexible diaphragm are held out of mutual contact. One liquid flows through a pumping circuit and constitutes a primary pressurization agent the pressure of which is, via the diaphragm, transferred to the other liquid surrounding a basket enclosing a soft walled container for the material to be compacted. According to the invention the basket is deformable so that the diaphragm can be pressed against it without being damaged by reactional forces. The result of the deformation capability of the basket is a reduction of the overall size of the pressure vessel.

6 Claims, 6 Drawing Figures

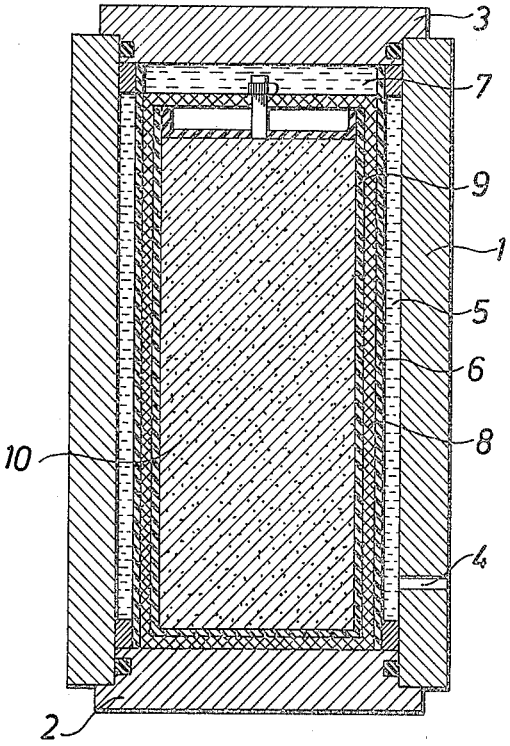
Fig. 2a
Fig. 2b
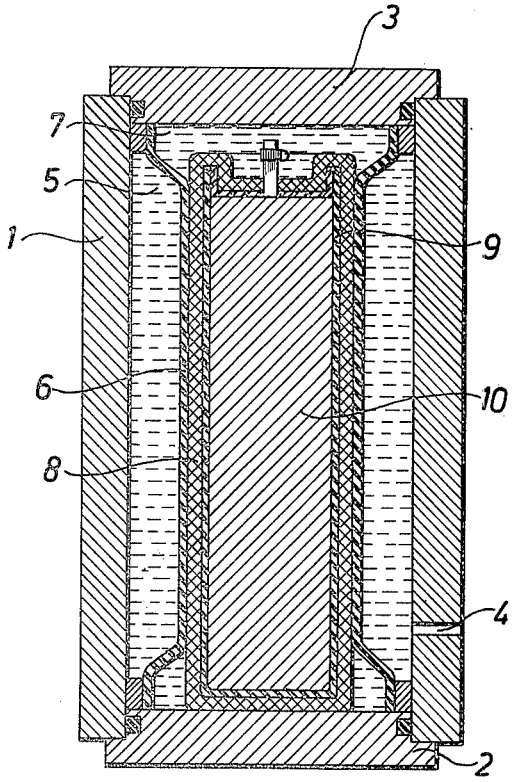

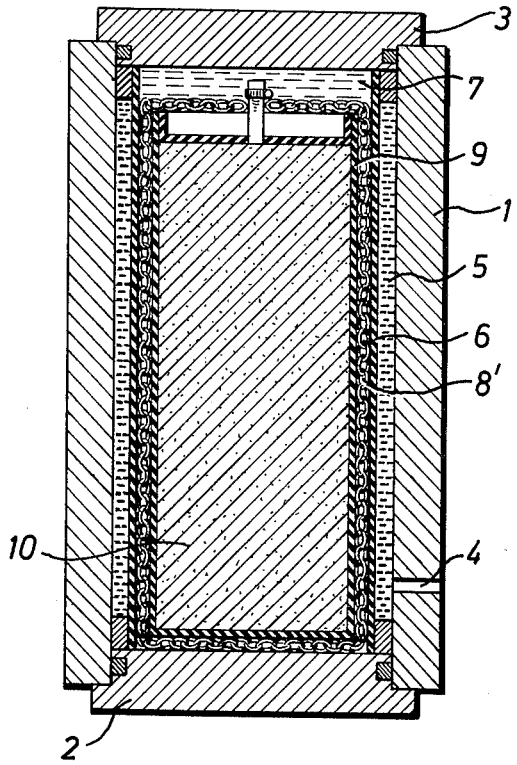
Fig. 3a
Fig. 3b
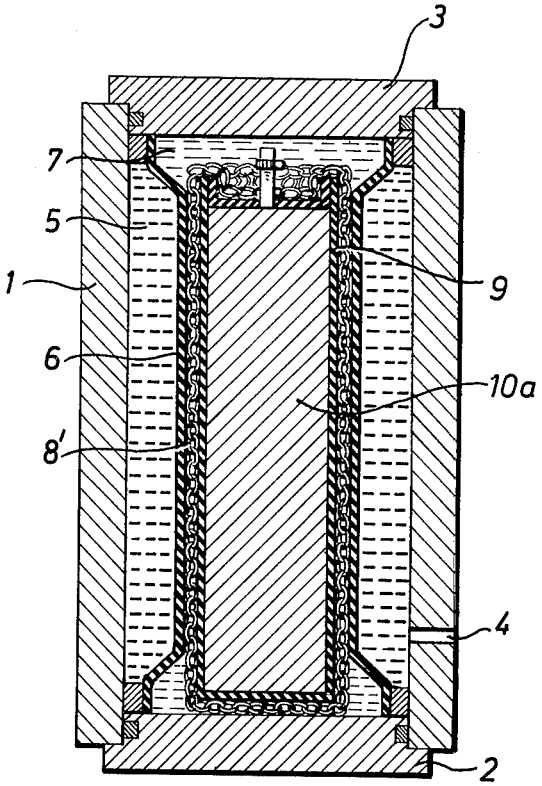

ISOSTATIC COMPACTOR OF PULVERULENT MATERIALS AND THE LIKE

The present invention relates to an apparatus by means of which a pulverulent material may be exposed to very high pressures for the purpose of compacting the material.

The apparatus comprises a sealed container housing the material during the compaction thereof. The container is surrounded by an envelope having perforated walls and often referred to as a "basket" by means of which the container may be introduced into and removed from the interior of a pressure vessel. The vessel confines a first liquid surrounding the container and the basket and, by a partition operating as a diaphragm, separated from a second liquid. When the second liquid is pressurized, the corresponding pressure is, via the diaphragm, transferred to the first liquid. The reason why two liquids are used will be given below.

In the first types of high pressure powder compaction apparatus only one liquid was used which acted directly against the outer wall of the powder container. The powder container normally consists of natural rubber since the costs for manufacturing the container then are much lower than if a synthetic rubber is used. When the liquid is pressurized, it will naturally be in contact with movable parts of pumps and valves. Since such parts, especially the pump bearings, must be lubricated a ideal liquid would be lubrication oil. However, si natural rubber is not resistant to conventional m l base lubrication oils, such oils could not be us . Instead, one used mixtures of water and glycol wh e the glycol yielded the lubricating properties. It was however rather soon established that the liquid in contact with the outer wall of the rubber container should not also constitute the pumping medium for the following reason. When the container is charged with powder, the corresponding work is normally carried out adjacent to the pressure vessel. For that reason, and unless the external walls of the rubber container are carefully cleaned upon completion of the charging step, it cannot be avoided that small amounts of the powder contaminate the liquid. The presence of even very sma amounts of powder in the liquid does, however, most drastically reduce the useful life of the pumps and the valves, especially when, as is often the case, the powder is metallic. The powder particles suspended in the liquid will then act as an abrasive and subject the pump bearings, the valve seats, etc. to such a heavy wear that the useful life of those components is reduced to about 10% of the normal values. It is easily realized that the corresponding repair operations very significantly increase the operational costs of the isostatic press. Those circumstances, for a long period of time, retarded the development of the art.

Ultimately a solution of the problems above discussed was, however, found. The solution was to use two liquids separated from each other. The one liquid, normally water, surrounded the rubber container, whereas the second liquid, a lubrication oil, circulated through pumps and valves. The pump pressure in the oil was then via a diaphragm transferred to the water. However, the advantages attained had to be bought at the price of another most significant disadvantage.

For mechanical strength reasons the rubber container cannot support the weight of the powder when it is to be immersed into the liquid. The same applies when the finished compacted workpiece shall be lifted up from the isostatic press. For that reason it was necessary to surround the rubber container with the basket above referred to which yields the mechanical strength. In some prior art isostatic presses the basket is simply constituted by a perforated tube provided with a bottom. When the powder is compacted, the volume thereof is reduced by 30–50%. This accordingly means that the diaphragm separating the water from the oil must be displaced a considerable distance. However, during that displacement the diaphragm, which as a rule consists of rubber, must not come into contact with any metallic parts of the apparatus, since such a contact would immediately destroy the diaphragm. This would naturally in turn mean that the two liquids formed a mixture or, stated otherwise, the disadvantages from which such liquid mixtures suffer and which have been accounted for above, would reappear. In this connection it must be borne in mind that the actual operation pressures often are of the order of magnitude of 200 MPa. It is realized that should a rubber diaphragm, subjected to such a pressure, be forced into contact with the wall of the above-mentioned perforated tubes, the rubber material would naturally immediately burst opposite the perforations.

There exist two basically different methods of protecting the diaphragm between the liquids from being brought into contact with metallic parts. According to the first known principle the diaphragm is horizontally oriented so that it forms a partition between a lower chamber containing pump oil and an upper chamber containing water which surrounds the basket and the rubber container. In such an isostatic press the vertical distance between the diaphragm and the bottom of the basket must consequently be so great that, when the deflection of the diaphragm has its maximum value, the diaphragm is still kept out of contact with the basket. Thus, application of this principle leads to a considerable increase of the axial dimension of the pressure vessel of the press, meaning that at least the height of the complete apparatus is also correspondingly increased.

According to the other known principle the diaphragm instead surrounds the basket in a tubular fashion so that the water is located radially inside the corresponding partition, whereas the oil is radially outside the same. While this solution avoids an increase of the vertical extension of the pressure vessel, the cross-section thereof must be considerably greater in order to guarantee that the diaphragm when maximally deformed does not come into contact with the basket.

In summing up, it can consequently be established that, according to both of the two known principles described, above the dimensions of the pressure vessel increase as compared with an apparatus operating with one liquid only. The pressure vessel, which normally is cylindrical, has thick walls made of high quality steel and has both of its ends closed by heavy steel plugs. In addition thereto, the vessel is usually surrounded by a frame comprising tension-biased steel wires. It is thus realized that relatively modest increases of the dimensions of the pressure vessel result in a significant increase of the cost of the apparatus as a whole.

The object of the present invention is to provide a high pressure apparatus of the type above defined which operates with two liquids each of which is located in a chamber separated from the other chamber by a deformable diaphragm. More specifically, the object of the invention is to provide an apparatus as just defined in which the use of two separate liquid chambers does not cause any increase of the volume of the pressure vessel as compared to pressure vessels operating with one liquid, or liquid mixture, only.

SUMMARY OF THE INVENTION

Stated otherwise, the object of the invention is to make it possible simultaneously to satisfy two conditions which apparently are incompatible. One condition is that the apparatus should include two chambers so that on the one hand the pump and the valves are in contact with lubrication oil only and, on the other, contamination of the liquid surrounding the powder container does not yield any disastrous results. The second condition is that the presence of a diaphragm separating the two liquid chambers shall not result in any increase of the volume of the pressure vessel. The invention is based on the realization that it is actually possible simultaneously to satisfy those two conditions, namely if the basket surrounding the rubber container housing the powder is comprised of a material capable of being deformed plastically and/or elastically. As will appear from the description below, this means that the rubber diaphragm may contact the basket and deform it without the diaphragm itself being damaged. That the basket material should be deformable means that the basket should either comprise an easily deformable material or be comprised of smaller pieces of a material which may per se be rather resistant to deformation but which are interconnected in such a way that during the pressure treatment the inner wall of the basket may approach the outer wall of the container.

BRIEF DESCRIPTION OF THE DRAWINGS

FIGS. 2*a* and 2*b* are vertical cross-sections of an apparatus according to the present invention, FIG. 2*a* being in the initial position and FIG. 2*b* showing the apparatus upon a completed pressure treatment.

FIGS. 3*a* and 3*b* illustrate a modified embodiment of the invention.

DETAIL DESCRIPTION

Figure 1A:
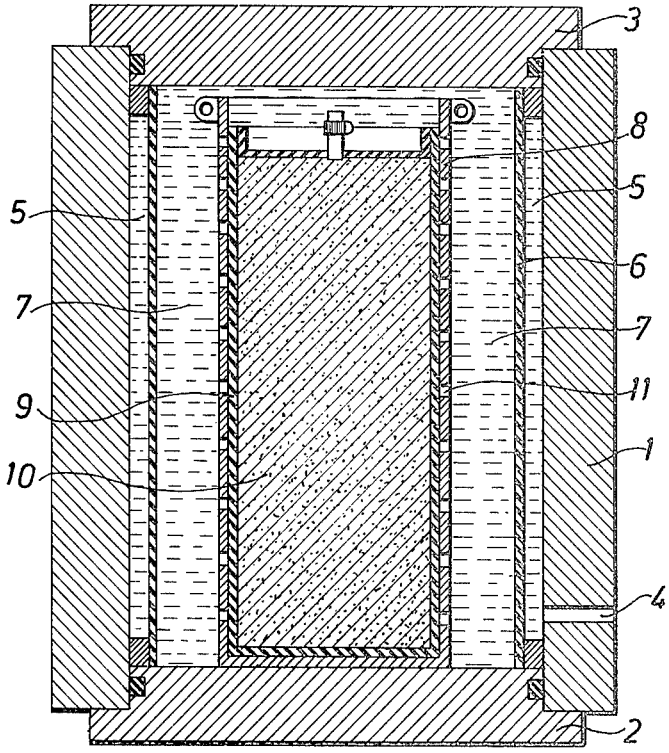
Fig. 1a PRIOR ART
FIG. 1*a* shows a vertical cross-section through a prior art isostatic press with the apparatus in the initial position, i.e. prior to pressurization.

Reference numeral 1 designates the prior art pressure vessel consisting of a cylinder having thick steel walls and, at both its ends, closed by heavy plugs 2 and 3. As has been mentioned above, such a pressure vessel is normally surrounded by a frams absorbing the reactional forces generated during pressurization and consisting of tension-biased steel wires. Accordingly, as such a frame does not form any portion of the present invention, it has not been shown on the drawing. Adjacent the bottom end plug 2 the cylinder wall 1 has a through bore 4 via which the interior of the pressure vessel can communicate with a pump (not shown) for the purpose of pressurizing the vessel. The pump circuit, via bore 4, communicates with an outer pressure chamber of annular cross-section housing the liquid 5. The corresponding chamber is defined by the inner wall of the pressure vessel 1 and by the outer wall of a tubular rubber diaphragm 6 extending vertically between the two ends of the pressure vessel. Liquid 5 may be considered a primary pressurization agent.

The space radially inside partition 6 forms a second, or interior, pressure chamber containing a secondary pressurization agent 7 which is also a liquid. The two liquids 5 and 7 are thus from a contact point of view mutually isolated but in terms of pressure transfer they appear as an integral liquid since pressure equalization takes place through diaphragm 6. Immersed in liquid 7 is the basket 8 enclosing an omnilaterally closed rubber container 9 which in turn houses the powder 10 to be compacted during the pressing process.

Figure 1B:
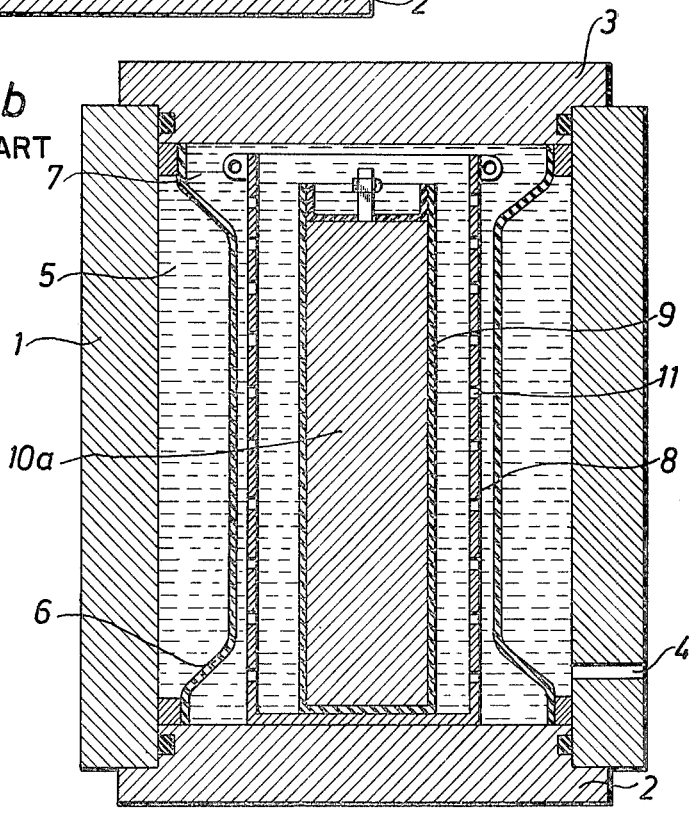
Fig. 1b PRIOR ART
FIG. 1*b* shows the apparatus of FIG. 1*a* upon a completed pressure treatment.

The description above of the structural characteristics of the pressure vessel applies both to the prior art device shown in FIGS. 1*a* and 1*b* and to the subject of the present invention illustrated in FIGS. 2*a* and 2*b*. The differences between the prior art and the novel device of the present invention are as follows.

In the known apparatus basket 8 consists of a relatively heavy metal tube the wall of which has a plurality of through holes 11. As has been explained above, this means that rubber diaphragm 6 must be kept out of contact with the outer wall of the basket. For that reason the diaphragm is, in its initial position shown in FIG. 1*a*, located at such a great radial distance from basket 8 that it will stay out of contact with the basket also upon completed compaction of the charge 10 in the basket, whereby the charge is converted into an integral, solid, rod-like body 10*a*. This means that the inner diameter of the pressure vessel must be selected to be so great that enough space is provided for the diaphragm to deflect radially inwards without touching tubular basket 8. As has also been mentioned above and as directly appears from the drawing, this requirement means that the total cross-section of the pressure vessel is increased, that the wall of cylinder 1 must be thicker and that also end plugs 2 and 3 must be larger and thicker than if that requirement did not have to be satisfied.

In contrast thereto, in the apparatus made according to the invention and shown in FIGS. 2*a* and 2*b* rubber diaphragm 6 is close to the outer wall of basket 8 already in its initial position. When the powder material 10 is compacted into a rod-like integral body 10*a*, basket 8 will be easily deformed and participate in the inwardly directed movement of the powder material so that its inner side is all the time in contact with the outer side of rubber container 9. According to the embodiment here illustrated to exemplify the invention the wall of the basket 8 has a braided structure. By virtue of this design diaphragm 6 can be permitted to contact basket 8 because the basket is, during the pressurization step, deformed so that there are not generated any reactional forces against the diaphragm 6 which could cause the diaphragm to burst.

When working the invention one can, as a matter of principle, choose between two different ways of making the basket deformable. The first alternative is to manufacture the basket from a material which is per se deformable. The second possibility is to use a basket comprised of a plurality of individual parts each of which may be made of a rigid material but which are interconnected in such a way that deformation of the basket as a whole can nevertheless take place. Baskets within the second catagory may be made of, for example, fabrics, soft synthetic plastic materials, wires, chains or the like. FIGS. 3*a* and 3*b* illustrate an embodiment of the invention in which the basket is comprised of chains 8'.

The primary advantage accompanying the use of a deformable basket is the elimination of the risk of the rubber wall 6 being destroyed by contact with the basket. This in turn means that it is no longer necessary to have such a great radial distance between partition 6 and the basket that the partition can bulge inwardly without touching the basket. The practical significance of this difference is apparent from a comparison between FIGS. 1*a*, 1*b* and FIGS. 2*a*, 2*b*. It is immediately seen that the invention has made it possible to radically decrease the dimensions of the pressure vessel with correspondingly reduced manufacturing costs.

I claim:

1. Apparatus for isostatic compaction of a pulverulent material, comprising:

a pressure vessel (1,2,3) containing first and second liquids (5,7) separated from each other;

container means (9) housing the pulverulent material during the compaction thereof and being insertable in said pressure vessel;

deformable supporting means (8) surrounding and supporting said container means (9) during its insertion into and removal out from said pressure vessel, said deformable supporting means (8) being in contact with said first liquid (5) surrounding said deformable supporting means (8) when it is in said pressure vessel; and flexible partition means (6) in said pressure vessel for separating said first and second liquids (5,7) from each other and providing pressure equalization between said liquids, said flexible partition (6) means contacting said deformable supporting means (8) upon pressurization of said liquids for compacting the pulverulent material in said container and deforming said supporting means (8) towards said container means (9) when contacted by said flexible partition means (6).

2. Apparatus according to claim 1, wherein said supporting means (8) comprises a deformable material.

3. Apparatus according to claim 1, wherein said supporting means (8) comprises a plurality of rigid units interconnected so as to permit alteration of their relative positions.

4. Apparatus according to claim 1, wherein said supporting means comprises a deformable braided structure.

5. Apparatus according to claim 4, wherein said braided structure is made of braided flexible material.

6. Apparatus according to claim 1, wherein said first liquid is water and said second liquid is oil.

* * * * *